US008549774B2

(12) United States Patent
Meschter et al.

(10) Patent No.: US 8,549,774 B2
(45) **Date of Patent: *Oct. 8, 2013**

(54) FLEXIBLE SHANK FOR AN ARTICLE OF FOOTWEAR

(75) Inventors: James Meschter, Portland, OR (US); Susanne Wolf-Hochdoerffer, Portland, OR (US); Emily Beth Dennison, Portland, OR (US)

(73) Assignee: Nike, Inc., Beaverton, OR (US)

( * ) Notice: Subject to any disclaimer, the term of this patent is extended or adjusted under 35 U.S.C. 154(b) by 1251 days.

This patent is subject to a terminal disclaimer.

(21) Appl. No.: 11/273,253

(22) Filed: Nov. 15, 2005

(65) Prior Publication Data

US 2007/0107264 A1 May 17, 2007

(51) Int. Cl.
*A43B 13/42* (2006.01)
*A43B 5/12* (2006.01)
*A43B 23/22* (2006.01)

(52) U.S. Cl.
USPC ..... 36/76 R; 36/8.3; 36/102; 36/108

(58) Field of Classification Search
USPC ..... 36/8.3, 76, 76 R, 102, 108, 145, 155, 36/182
See application file for complete search history.

(56) References Cited

U.S. PATENT DOCUMENTS 2,779,110 A * 1/1957 Howell ..... 36/156
3,863,272 A * 2/1975 Guille ..... 2/239
4,059,910 A * 11/1977 Bryden et al. ..... 36/103
4,075,772 A 2/1978 Sicurella
4,399,621 A 8/1983 Dassler
4,476,638 A * 10/1984 Quacquarini et al. ..... 36/86
4,542,598 A 9/1985 Misevich et al.
4,619,056 A 10/1986 Lin et al.
4,779,361 A * 10/1988 Kinsaul ..... 36/102
D300,686 S 4/1989 Peterson
4,922,631 A 5/1990 Anderié

(Continued)

FOREIGN PATENT DOCUMENTS

CN 2592000 Y 12/2003
DE 304144 C 3/1918

(Continued)

OTHER PUBLICATIONS

International Search Report dated Mar. 22, 2007.
Office Action issued Nov. 6, 2009 in corresponding Chinese Patent Application No. 200680049074.8, and English translation thereof.
Office Action issued Jun. 6, 2010 in related European Patent Application No. 06837425.5.

(Continued)

*Primary Examiner* — Jila M Mohandesi
*Assistant Examiner* — Sharon M Prange
(74) *Attorney, Agent, or Firm* — Banner & Witcoff, Ltd.

(57) ABSTRACT

A directionally flexible shank for an article of footwear is disclosed, which provides support to the bottom of a user's foot while providing flexibility for foot movements in one or more particular directions. The directionally flexible shank may also support the arch of the foot. The directionally flexible shank may include a plurality of articulatable segments that can easily rotate with respect to each other in a first direction and thereby permit the directionally flexible shank to flex away from the foot, while limiting articulation in an opposite direction. The articulatable segments are connected to each other via hinge structures, which may include living hinges formed of a thermoplastic material. The hinge structures may also be formed from a flexible sheet attached to a bottom portion of the directionally flexible shank. Methods are also disclosed for manufacturing the directionally flexible shank.

13 Claims, 20 Drawing Sheets

(56) References Cited

U.S. PATENT DOCUMENTS

| | | | | |
|---|---|---|---|---|
| 5,319,866 | A | 6/1994 | Foley et al. | |
| D403,847 | S | 1/1999 | Blythe | |
| 5,903,985 | A * | 5/1999 | DeMarchi | 36/155 |
| 6,076,284 | A | 6/2000 | Terlizzi | |
| 6,128,834 | A | 10/2000 | Vecchiola et al. | |
| 6,189,239 | B1 | 2/2001 | Gasparovic et al. | |
| 6,393,736 | B1 * | 5/2002 | Greer et al. | 36/155 |
| 6,895,693 | B2 | 5/2005 | Baruck | |
| 7,337,558 | B2 | 3/2008 | Terlizzi et al. | |
| 7,685,747 | B1 | 3/2010 | Gasparovic et al. | |
| 2004/0020081 | A1 | 2/2004 | Symons et al. | |
| 2005/0138839 | A1 | 6/2005 | Terlizzi et al. | |
| 2007/0107265 | A1 | 5/2007 | Mueller et al. | |

FOREIGN PATENT DOCUMENTS

| | | | |
|---|---|---|---|
| EP | 0997081 | A1 | 5/2000 |
| EP | 1074194 | A1 | 2/2001 |
| GB | 2156652 | A | 10/1985 |
| WO | 0249466 | A1 | 6/2002 |

OTHER PUBLICATIONS

Office Action issued May 20, 2010 in related Chinese Patent Application No. 200680049074.8, and English translation thereof.

Office Action issued Aug. 26, 2010 in related Chinese Patent Application No. 200680049074.8, and English translation thereof.

Office Action issued Oct. 12, 2011 in related U.S. Appl. No. 11/273,243.

Office Action issued Jun. 19, 2009 in corresponding Chinese Application No. 200680042564.5 and English translation thereof.

International Search Report issued Mar. 30, 2007 in related PCT Application No. PCT/US2006/043959.

Office Action issued Jun. 28, 2011 in related European Patent Application No. 06827750.8.

Office Action issued Oct. 12, 2011 in European Patent Application No. 06837425.5.

Office Action issued Nov. 24, 2011 in Chinese Patent Application No. 201010540019.7, and English translation thereof.

Examining Division's Communication, dated Oct. 30, 2012, issued in corresponding European Application No. 06837425.5.

* cited by examiner

FLEXIBLE SHANK FOR AN ARTICLE OF FOOTWEAR

BACKGROUND OF THE INVENTION

1. Field of the Invention

The present invention relates to the field of footwear. The invention concerns, more particularly, a flexible shank for an article of footwear that provides support to the bottom of a user's foot along with flexibility in one or more selected directions.

2. Description of Background Art

Conventional articles of footwear include two primary elements, an upper and a sole structure. The upper provides a covering for the foot that securely receives and positions the foot with respect to the sole structure. The sole structure is secured to a lower portion of the upper and is generally positioned between the foot and the ground. In addition to attenuating ground reaction forces, the sole structure may provide traction, control potentially harmful foot motion, and support the bottom of the foot and the arch. Accordingly, the upper and the sole structure operate cooperatively to provide a comfortable structure that is suited for a wide variety of ambulatory activities, such as walking and running.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

The sole structure of conventional articles of footwear generally incorporates multiple layers that are conventionally referred to as an insole, a midsole, and an outsole. The insole is a thin, comfort-enhancing member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling foot motions and attenuating ground reaction forces. The outsole forms the ground-contacting element of footwear and is usually fashioned from a durable, wear-resistant material that includes texturing to improve traction.

The primary element of a conventional midsole is a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used. In addition to polymer foam materials, conventional midsoles may include, for example, stability devices that resist over-pronation and moderators that distribute ground reaction forces. They may also include support features in the arch region, or they may include a removable arch support placed on top of the midsole.

Some conventional articles of footwear for use with dancing and dance-related activities, such jazz shoes, dance shoes, and dance sneakers designed for use with exercise routines, have extremely flexible sole structures. These sole structures provide little support to the foot, and often lack a midsole entirely. These shoes permit the user to easily flex the arch region of the foot for various dance steps, but lack support for the user's arch. Other types of dance-related shoes have stiffer sole elements that are desirable for various movements such as turns and toe stands, which may include an arch support, but that are difficult to bend in the arch region.

SUMMARY OF THE INVENTION

Aspects of the present invention involve a directionally flexible shank for an article of footwear, which provides support to the bottom of a user's foot while providing flexibility for foot movements in one or more particular directions. The directionally flexible shank may also support the arch of the foot. The directionally flexible shank may include a plurality of articulatable segments that can easily rotate with respect to each other in a first direction and thereby permit the directionally flexible shank to flex away from the foot, while limiting articulation in an opposite direction. The articulatable segments are connected to each other via hinge structures, which may include living hinges formed of a thermoplastic material. The hinge structures may also be formed from a flexible sheet attached to a bottom portion of the directionally flexible shank.

Methods for forming the directionally flexible shank are also provided. The advantages and features of novelty characterizing aspects of the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
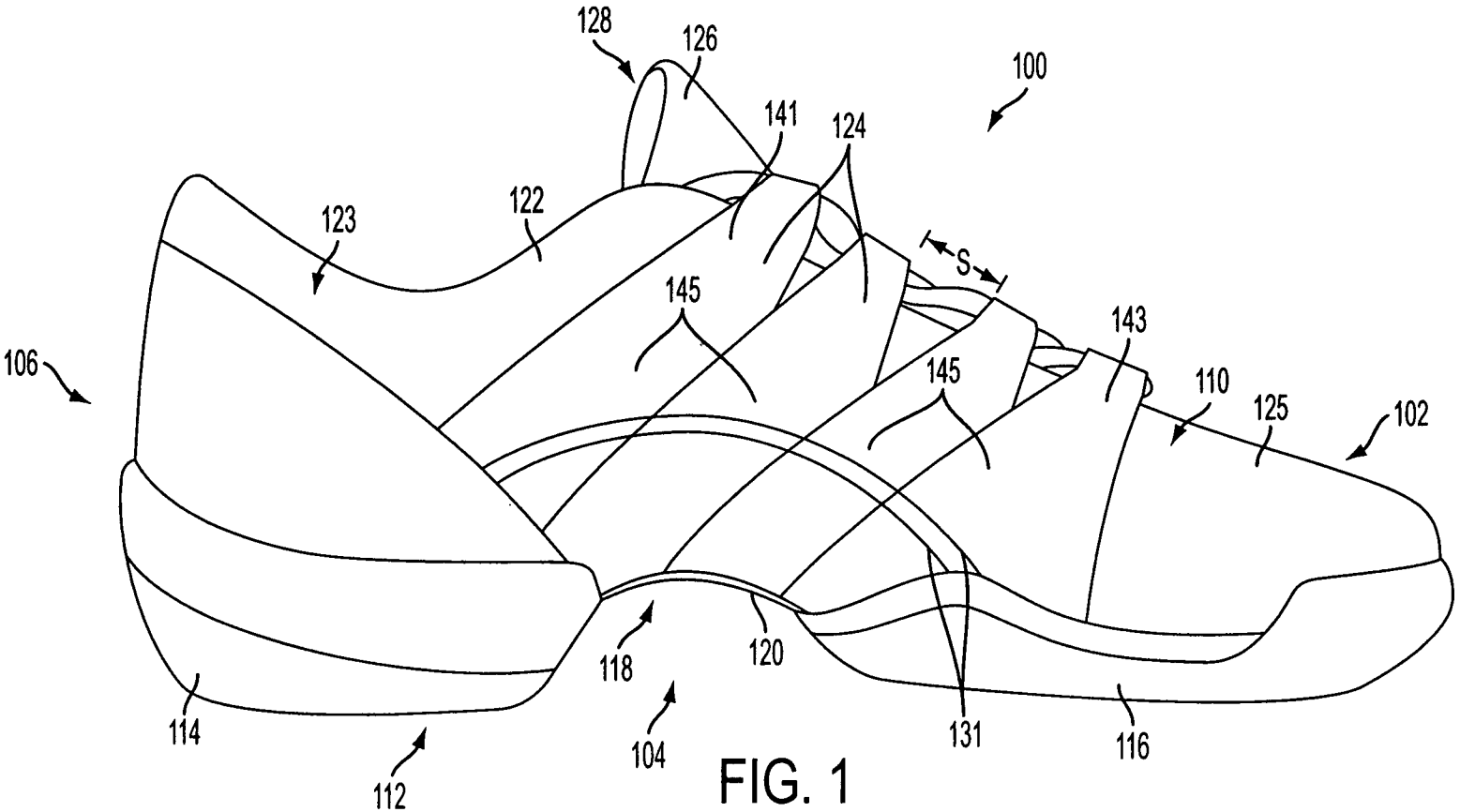
FIG. 1 is a lateral elevational view of an article of footwear according to embodiments of the invention.

The following discussion and accompanying figures disclose an article of footwear 100 in accordance with various aspects of the present invention. Footwear 100 is depicted in the figures and discussed below as having a configuration that is suitable for athletic activities, particularly dance activities and exercises that make use of dance related movements, such as jazz-type exercise routines. As such, aspects of footwear 100 provide support to the bottom of the foot, such as support to the arch of the foot, when the user steps or otherwise applies downward force to the foot, while permitting directional flexibility in the arch region. Other aspects provide for a secure fit of the upper to the user's foot, while permitting flexibility for foot bending, curling and/or twisting, which are common movements performed during dance activities. Movement of the foot, the arch support and other components of footwear 100 are described herein as movement in particular directions. However, it is understood that the term direction can refer to rotational movements, linear movements, combinations thereof, or other descriptors of movement. Similarly, descriptions with respect to forces are intended to be general and may include moments, torques, vectors, pressures or other descriptors.

Although these and other aspects are discussed in the context of footwear 100, embodiments of the invention may include one or more aspects described herein arranged in various combinations. In addition, the aspects and concepts disclosed with respect to footwear 100 may be applied to various footwear styles, such as footwear for general use and specially designed footwear styles. For instance, aspects of footwear 100 may be applicable for specially designed footwear for a wide range of athletic activities, including exercise routines, dancing, basketball, baseball, football, soccer, walking, and hiking, for example, and may also be applied to various non-athletic footwear styles. Accordingly, one skilled in the relevant art will recognize that the concepts disclosed herein may be applied to a wide range of footwear styles and are not limited to the specific embodiments, configurations and uses discussed below and depicted in the figures.

Footwear 100 is generally depicted in FIGS. 1-11 and includes an upper 110 and a sole structure 112. Upper 110 is formed from various material elements that are stitched and/or adhesively-bonded together to form an interior void, which comfortably receives a foot and secures the position of the foot relative to sole structure 112. Sole structure 112 is secured to a lower portion of upper 110 and provides a durable, wear-resistant component for attenuating ground reaction forces as footwear 100 impacts the ground. Upper 110 and sole structure 112 cooperatively articulate, flex, stretch, or otherwise move to provide robust support to the user's foot and to provide flexibility for foot movements in certain directions and arrangements. That is, upper 110 and sole structure 112 are configured to permit great flexibility for certain movements, such as when the user flexes their arch to curl the bottom of the foot or to otherwise bend their forefoot toward the rearfoot or when the user twists the forefoot with respect to the rearfoot. However, upper 110 and sole structure 112 are configured to be dual purpose, in that they provide robust support for certain other movements, such as attenuating forces and providing arch support during the application of downward force by the user when running or walking.

In contrast with footwear 100, conventional dance shoes either provide good support to the bottom of the user's foot without providing good flexibility for dance-related movements, or they provide good flexibility for dance-related movements while providing little support to the bottom of the user's foot or the arch region. That is, flexibility and support are generally competing interests that conventional dance shoes address by primarily focusing on one or the other. In contrast, footwear embodiments that include aspects of the invention illustrated by footwear 100 can provide good flexibility for movements in one or more particular directions along with robust support for movements in other directions.

For reference purposes, footwear 100 may be divided into three general regions as shown in FIG. 1: a forefoot region 102, a midfoot region 104, and a heel region 106. Regions 102-106 are not intended to demarcate precise areas of footwear 100. Rather, regions 102-106 are intended to represent general areas of footwear 100 that provide a frame of reference for the following discussion. Although regions 102-106 apply generally to footwear 100, references to regions 102-106 may also apply specifically to upper 110, sole structure 112, or an individual component or portion within either of upper 110 or sole structure 112.

Figure 2:
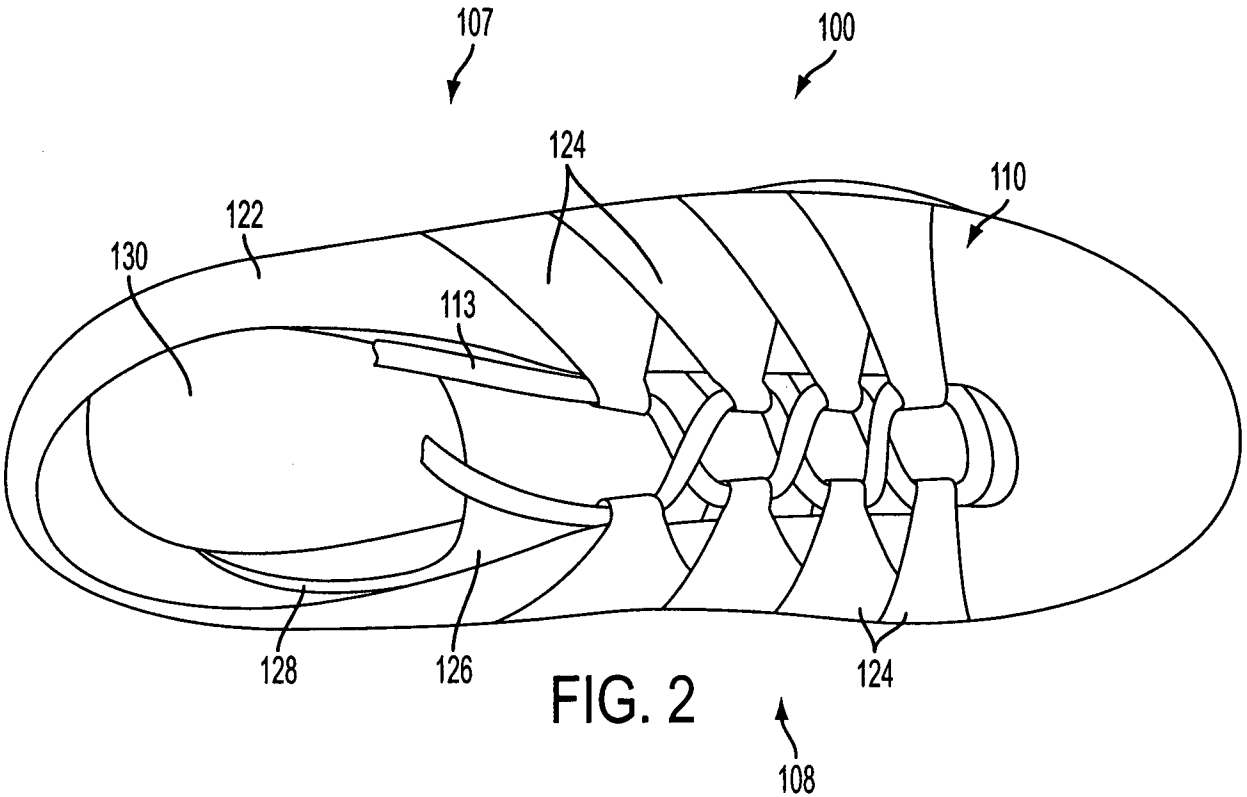
FIG. 2 is a top plan view of the article of footwear of FIG. 1.

As shown in FIG. 2, the various material elements forming upper 110 combine to provide a structure having a lateral side 107, an opposite medial side 108, a tongue 126, and an interior boot 128 that form the void within upper 110. Lateral side 107 extends along each of regions 102-106 and is generally configured to contact and cover a lateral portion of the user's foot. In addition, lateral side 107, medial side 108, and tongue 126 cooperatively form an ankle opening in heel region 106 to provide the user's foot with access to the void within upper 110. Also, articulatable straps 124 are provided on both the lateral side and the medial side to assist with securing footwear 100 to the foot while providing flexibility for certain movements, such as foot bending or curling.

Tongue 126 extends longitudinally along upper 110 and is positioned to contact the instep area of the foot. Side portions of tongue 126 are secured to an interior surface of each of lateral side 107 and medial side 108. A lace 113 extends over tongue 126 and through apertures formed in lateral side 107 and medial side 108, which are preferably formed through distal end portions of straps 124. Tongue 126 extends under lace 113 to separate lace 113 from the instep area of the foot.

By increasing the tension in lace 113, the tension in lateral side 107 and medial side 108 may be increased so as to draw lateral side 107 and medial side 108 into contact with the foot. Similarly, by decreasing the tension in lace 113, the tension in lateral side 107 and medial side 108 may be decreased so as to provide additional volume for the foot within upper 110. This general configuration provides, therefore, a mechanism for adjusting the fit of upper 110 and for accommodating various foot dimensions. Straps 124 cooperate with lace 113 to secure footwear 100 to the foot while enhancing flexibility for certain movements. In particular, as discussed further along with FIG. 5A, straps 124 can articulate with respect to each other to enhance flexibility for foot curling or bending around the arch region.

A variety of materials are suitable to form upper 110. Upper 110 may be formed from combinations of leather, synthetic leather, natural or synthetic textiles, polymer sheets, polymer foams, mesh textiles, felts, non-woven polymers, or rubber materials, for example. The upper may be formed from multiple material layers that include an exterior layer, a middle layer, and an interior layer. The materials forming the exterior layer may be selected based upon the properties of wear-resistance, flexibility, and air-permeability. For instance, the toe area and the heel area of upper 110 may be formed of a tough leather, a synthetic leather, or a rubber material that imparts a relatively high degree of wear-resistance, whereas the mid-portion may be formed of a textile material that provides greater flexibility or air-permeability. If the upper includes a middle layer, it may be formed from a lightweight polymer foam material that attenuates ground reaction forces and/or that protects the foot from objects that may contact the upper. Similarly, an interior layer of the upper may be formed of a moisture-wicking textile that removes perspiration from the area immediately surrounding the foot. The various layers may be joined with an adhesive, and stitching may be utilized to join elements within a single layer or to reinforce specific areas of the upper.

As depicted in FIG. 1, upper 110 is generally formed from two material layers that are stitched or adhesively bonded together at particular locations, but that may also be translatable with respect to each other at various locations for flexibility purposes. The material layers generally include an interior boot 128 and an exterior material 122. Although discussed as two material layers, interior boot 128 and exterior material 122 may actually be made of the same type of material. Thus, interior boot 128 and exterior material 122 are distinct layers of materials, rather than necessarily being different types of materials. As shown, the exterior material 122 includes a heel portion 123, a toe portion 125, and articulatable straps 124 between the heel and toe portions. Exterior material 122 is positioned on an exterior of upper 110, and interior boot 128 is positioned on an interior of the upper so as to form a mid-portion of the void within upper 110. Lower edges 127 (see FIG. 4) of exterior material 122 wrap around a bottom portion of the void for the foot and are attached together via stitches or other mechanisms proximate an upper portion of sole structure 112.

Heel portion 123 wraps around the heel of the foot and attaches on both the lateral side 107 and the medial side 108 to the rearmost straps 141 of the articulatable straps. Similarly, toe portion 125 wraps around the toe of the foot and attaches on both the lateral side and the medial side to the foremost straps of the articulatable straps 124. Central articulatable straps 145 are disposed between the heel portion and the toe portion of the upper, and extend in a generally spoke-like arrangement from the midfoot region 104 of the sole structure 112. Except for the rearmost 141 and foremost strap 143, each articulatable strap 124 overlaps an adjacent strap to its rear while being partially covered by an adjacent strap to its front. Similarly, the rearmost strap 141 is partially covered by the adjacent strap in front of it and the foremost strap 143 overlaps the adjacent strap behind it. Thus, the articulatable straps can translate with respect to adjacent straps by sliding with respect to one another. The straps may be free to translate relative to each other. They also may be fixed at various points to adjacent straps to limit the amount of articulation. Fixing adjacent straps at various points can provide varying degrees of movement between the straps to control the bending flexibility of the upper. For instance, as shown in configuration of FIG. 1, radial stitch lines 131 may attach adjacent straps to one another such that the straps can articulate with respect to each other at strap regions located above stitch lines 131 (i.e., between the stitch line 131 and the lace 113), but are relatively static with respect to each other below stitch lines 131 (i.e., between the stitch line and the sole structure 112).

Figure 5A:
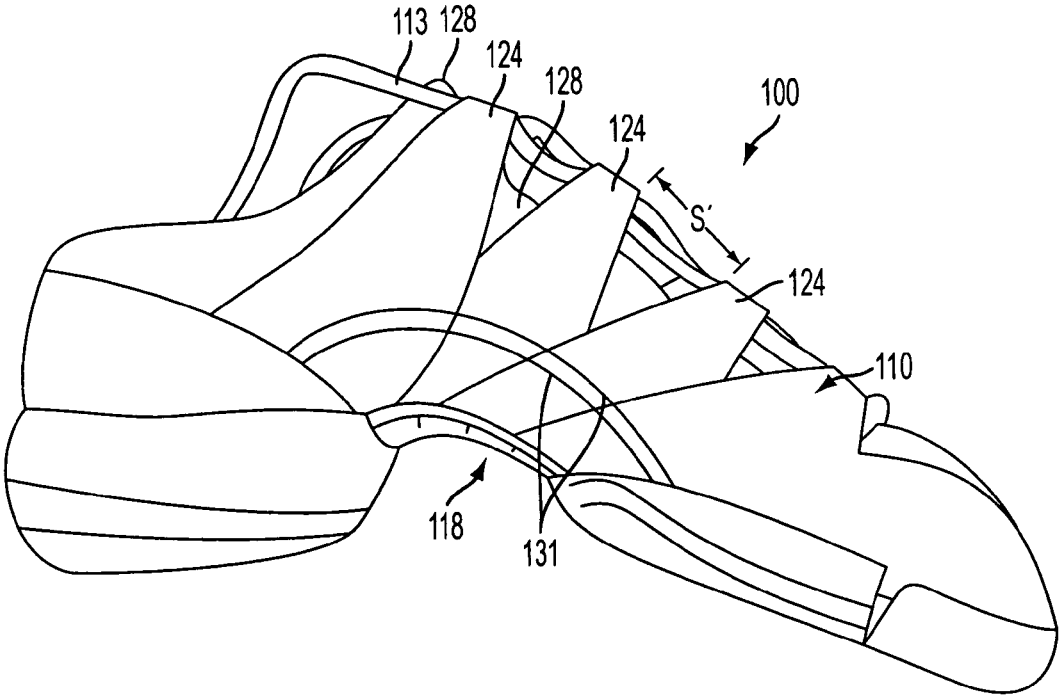
FIG. 5A is a lateral elevational view of the article of footwear of FIG. 1 shown in a flexed arch configuration.

Hence, a desired degree of flexibility can be provided for curling of the foot or other bending movements of footwear 100 via the articulatable strap configuration. FIG. 5A illustrates articulation of straps 124 when the foot is curled or bent downward. As shown, distal end portions of the straps where they engage lace 113 are spaced a distance S', which is further apart from one another in comparison with distance S of the non-flexed configuration shown in FIG. 1. As further shown in FIG. 5A, the straps articulate with respect to each other as they extend from stitch lines 131, but remain substantially static below the stitch lines during bends. Lace 113 is preferably attached to the end portions of the straps, such that the lace moves with the straps as the spoke-like configuration expands and contracts. As such, lace 113 adjusts during bending movements to maintain uniform support across the top portion of the foot.

As depicted in FIGS. 1 and 2, interior boot 128 wraps inside upper 110 from the sole structure 112 at the lateral side 107 and across the top of the upper to the sole element at the medial side 108, thereby forming an interior boundary for a portion of the void within the upper. Interior boot 128, therefore, along with the sole structure 112, encloses the midfoot region 104 of the foot and much of the forefoot portion 102. Although not necessary, tongue 126 is preferably formed as a portion of interior boot 128. Interior boot 128 is preferably made from a resilient, air-permeable material, such as a stretch satin material, which snugly embraces the foot while being able to flex and stretch along with foot movements while providing air-permeability to the foot. In other configurations, boot 128 may be made from a synthetic rubber material, such as materials known as NEOPRENE, LYCRA or SPANDEX.

Interior boot 128 preferably extends along the central portion of the upper 110 without covering the toe portion of the foot. As such, interior boot 128 snugly embraces the foot without restricting movement of the toes within footwear 100. When the user bends, curls or twists the foot, the user's toes are able to translate within upper 110 as necessary without binding, as may occur with a closed-toe interior boot configuration. For instance, when the user curls the foot about arch portion 118, toe portion 102 of the footwear may slide forward away from the user's toes. Interior boot 128 does not bind the foot or limit movement of the user's toes, because the interior boot does not cover the toes.

Interior boot 128 may be made from a material that slides easily against an adjacent material, such as a stretch satin material. Thus, an exterior surface of interior boot 128 can slide easily against an interior surface of exterior material 122. This can improve flexibility of footwear 100 during various movements, such as while performing dance movements. For instance, in the bending example shown in FIG. 5A, articulatable straps 124 can easily slide with respect to interior boot 128 when the user bends the foot. The interior boot 128 cooperates with exterior material 122 to provide snug retention of the user's foot within footwear 100, while providing good flexibility of the upper 110 for bending, curling, twisting or other movements of the foot.

Figure 4:
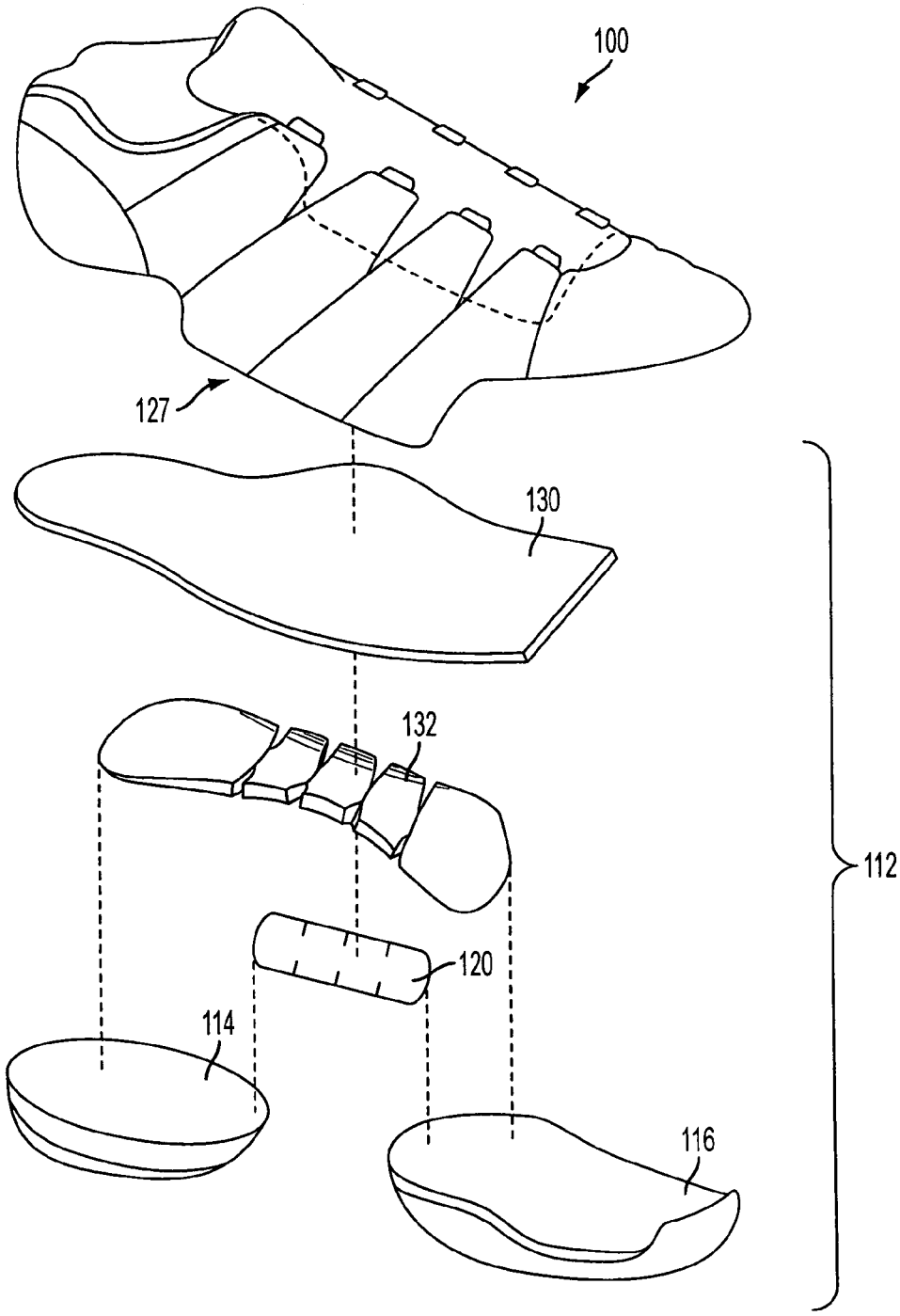
FIG. 4 is an exploded view of the article of footwear of FIG. 1.

FIG. 4 shows an exploded view of footwear 100 and sole structure 112. As shown, sole structure 112 generally includes an insole liner 130, an arch support 132, a rear outsole 114 coupled to the arch support, and a forefoot outsole 116 coupled to the arch support. The insole liner is provided inside the void of the upper above lower edges 127 when they are mated to each other. The arch support 132 is also disposed above lower edges 127 when mated together and is located beneath the insole liner.

Insole liner 130 contacts the plantar (lower) surface of the foot and enhances the comfort of footwear 100. The liner may be a resilient, polymer foam material, such as polyurethane or ethylvinylacetate, which generally extends throughout the length of the footwear. The liner assists with absorbing, attenuating and/or diffusing forces encountered when the foot impacts the ground. However, the liner is preferably relatively flexible for permitting movement of the foot in various directions and configurations, such as bending, twisting or other dance-related movements.

As shown in FIG. 4, liner 130 could extend from the heel region and terminate at a mid-portion of the forefoot region, rather than fully extending through the length of the footwear to the front toe region. In other words, liner 130 may not extend under the user's toes in some configurations, which can enhance the bendability of the arch. In such a configuration, a foreward portion of the liner can more easily slide with respect to the forefoot outsole as the user bends the arch. In other configurations, the liner may fully extend to a front portion of the forefoot region, which may be advantageous for limiting bendability of the arch or for providing additional cushion to the forefoot.

Figure 3:
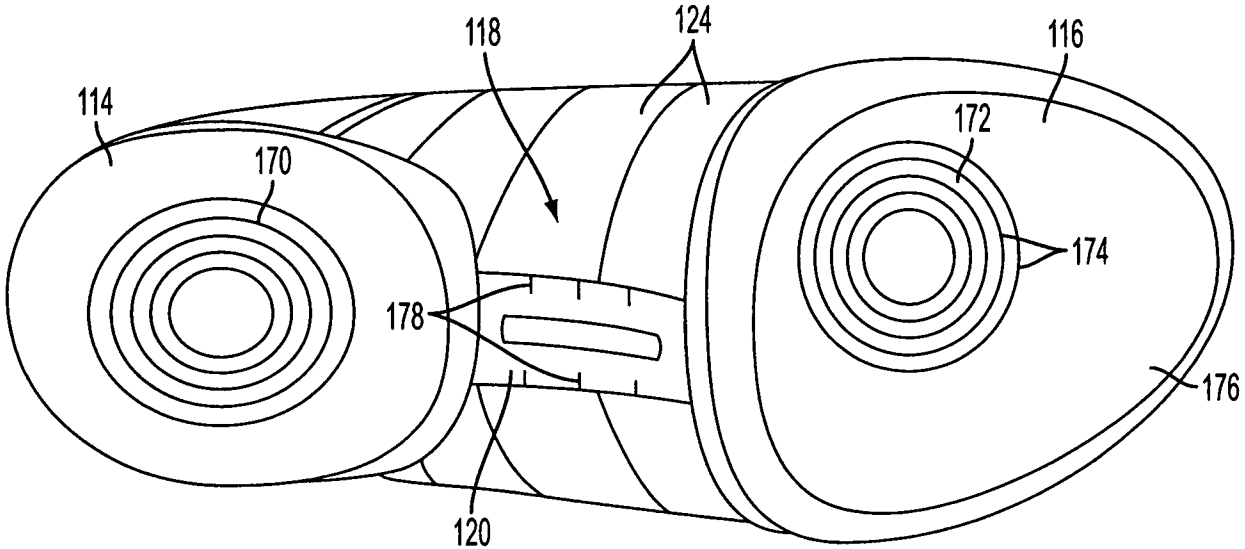
FIG. 3 is a bottom plan view of the article of footwear of FIG. 1.

As further shown in FIG. 4, sole structure 112 may include a bridge 120 in the arch region 118 connecting the rear outsole 114 to the forefoot outsole 116. The bridge 120 may provide structural advantages as well as aesthetic advantages, such as covering a seam between edges 127 of the upper and accentuating the flexible arch to users of footwear 100. The bridge may be formed of a thermoplastic material, such as nylon, polyethylene, polypropylene or a polyethyl block amide, that connects the outsole structures 114 and 116 in a resilient manner. The bridge may also include relief notches 178 that enhance its ability to twist along its longitudinal axis. In other configurations, bridge 120 may be made from a relatively rigid material, such as a spring metal that holds or encourages the outsole structures in a desired configuration. FIG. 3 shows bridge 120 from a bottom view as it connects rear outsole 114 and forefoot outsole 116 while covering the seam between edges 127 of the upper.

Rear outsole 114 and forefoot outsole 116 are both directly attached to arch support 132 in the configuration of FIG. 4. However, in other configurations, outsole structures 114 and 116 may be attached to the arch support via intermediary structures, such as a midsole structure (not shown). In addition, only one of the outsole structures 114 and 116 may be fixed to the arch support in other configurations. In the configuration shown, forefoot and rear portions of the arch support may respectively be attached the rear outsole and forefoot outsole via an adhesive, or via other attachment mechanisms such as a melt bond or a mechanical bond.

Outsole structures 114 and 116 provide wear-resistance for footwear contact with the ground. Suitable materials for outsole structures 114 and 116 include any of the conventional rubber materials that are utilized in footwear outsoles, such as carbon black rubber compound. The outsole structures are separated to permit independent movement of the rear outsole 114 with respect to forefoot outsole 116, and vice versa, which provides flexibility for movements in various directions. As such, the foot can bend, curl, twist and flex for various dance-related movements without the forefoot or rear foot being significantly restrained with respect to the other.

In some configurations, the outsole structures can include directional translation regions 170 and 172 (see FIG. 3), which can enhance the user's ability to slide or translate the footwear in certain directions with respect to the ground or other contact surface. The directional translation regions 170 and 172 shown in FIG. 3 preferably have a lower coefficient of friction with respect to the remainder of the outsole contact surface 176, which allows the user to more easily move their foot with respect to a contact surface when the person concentrates foot support on one those regions. For example, if the user rocks forward on the forefoot outsole and generally concentrates support on directional translation region 172, the user can more easily twist on region 172 in comparison with spreading support over the entire contact surface of the forefoot outsole.

The directional translation regions may be formed from a material having a relatively low coefficient of friction, such as leather or leather-like material, in comparison with the remaining contact surface 176, which may be formed from a rubber material having a comparatively high coefficient of friction. The directional translation regions can be formed to favor movements in certain directions, such as twisting movements or forward sliding movements. As shown in FIG. 3, the directional translation regions can include directional guides 174 or other geometry that encourages movements in desired directions. As an example, directional guides 174 could be circular ridges or grooves as shown in FIG. 3, which encourage rotation on directional translation regions 170 and 172. In other configurations, directional guides 174 could be parallel lines angled in a desired direction of movement, such as aligned with an axis from the rear foot to the forefoot to encourage forward sliding movement on the directional guides.

Figure 5B:
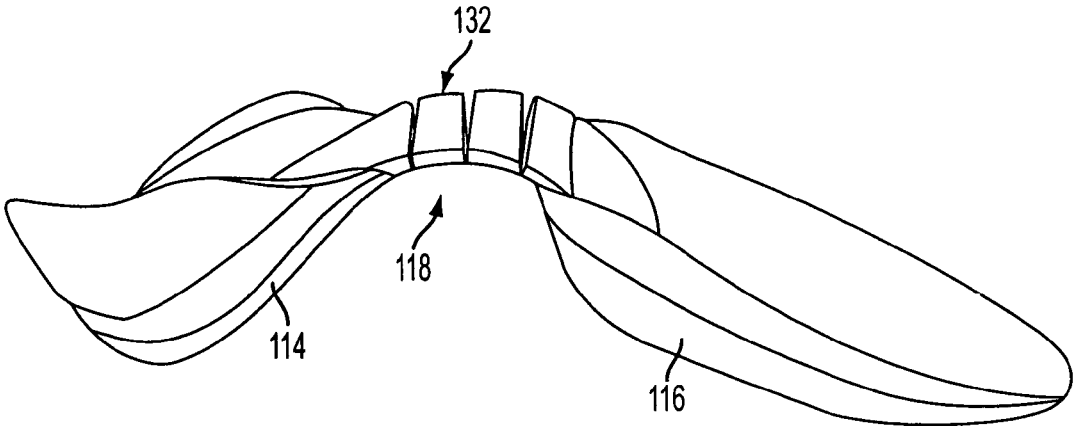
FIG. 5B shows a portion of the sole structure of the article of footwear of FIG. 5A.
Figure 6:
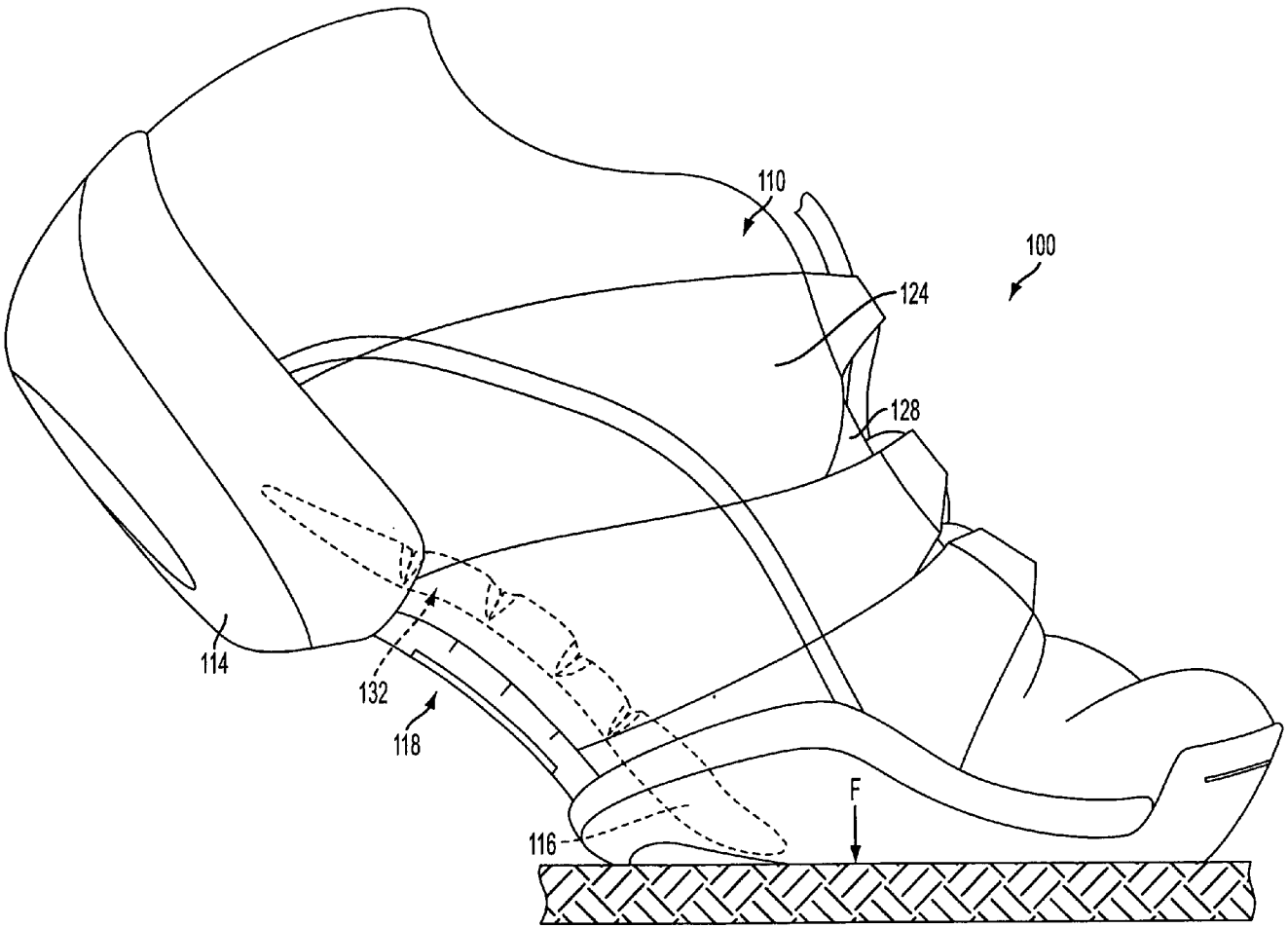
FIG. 6 is a lateral elevational view of the article of footwear of FIG. 1 shown in a flexed forefoot configuration during forefoot contact with the ground.

As further shown in FIG. 4, arch support 132 extends along the midfoot region 104 of the footwear and may extend into the forefoot and heel regions. In general, arch support 132 is a directionally flexible shank that provides a relatively rigid support for downwardly applied forces by the foot, such as is typically encountered when walking or running. In the configuration shown in FIG. 4, the directionally flexible shank is contoured to provide support to the arch of the foot when the foot applies downward force to the sole structure 112. Arch support 132 is directionally flexible in that it is configured to easily bend or flex in one or more directions, but is configured to resist bending or flexing in other directions. For instance, arch support 132 bends easily in a first direction to accommodate curling or bending of the foot, but provides a rigid support in the opposite direction. Thus, as shown in FIG. 5B, arch support may easily flex to permit the heel outsole 114 to move toward the forefoot outsole 116 as the user bends the foot about the arch region 118. However, as shown in FIG. 6, arch support resists movement in the opposite direction, and thereby supports the bottom of the foot and the arch when the user applies downward force F to the foot. Thus, for many downwardly applied forces by the foot, arch support acts similar to conventional midsoles or a shank thereof to distribute applied forces and to provide support to the bottom of the foot, which may include support for the arch.

Arch support 132 is disposed in the location commonly occupied by a midsole in conventional articles of footwear; although, it can exist along with a midsole structure. Conventional midsoles are unitary, polymer foam structures that extend throughout the length of the foot and have a stiffness or inflexibility that inhibits the natural motion of the foot. In contrast with the conventional footwear midsole, arch support 132 has an articulated structure that imparts relatively high flexibility and articulation in one or more directions. The flexible structure of arch support 132 (in combination with the structure of upper 110 as discussed above) is configured to complement the natural curling motion of the foot during running or other activities, and may impart a feeling or sensation of barefoot running. In addition, it complements more severe curling and bending of the foot that commonly occurs along with dance-related activities. In contrast with barefoot running or many conventional dance shoes, however, arch support 132 attenuates ground reaction forces and decreases the overall stress upon the foot when it impacts the ground during downward movements. Thus, it permits flexible movements in a bending direction away from the foot, while providing structural support for downward movements of the foot.

Figure 7A:
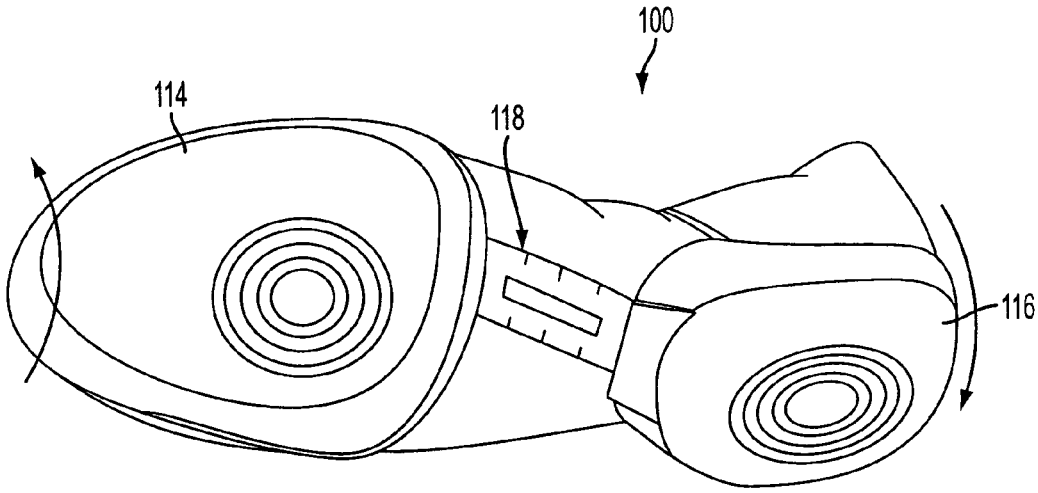
FIG. 7A is a bottom plan view of the article of footwear of FIG. 1 illustrating a first twist configuration.
Figure 7B:
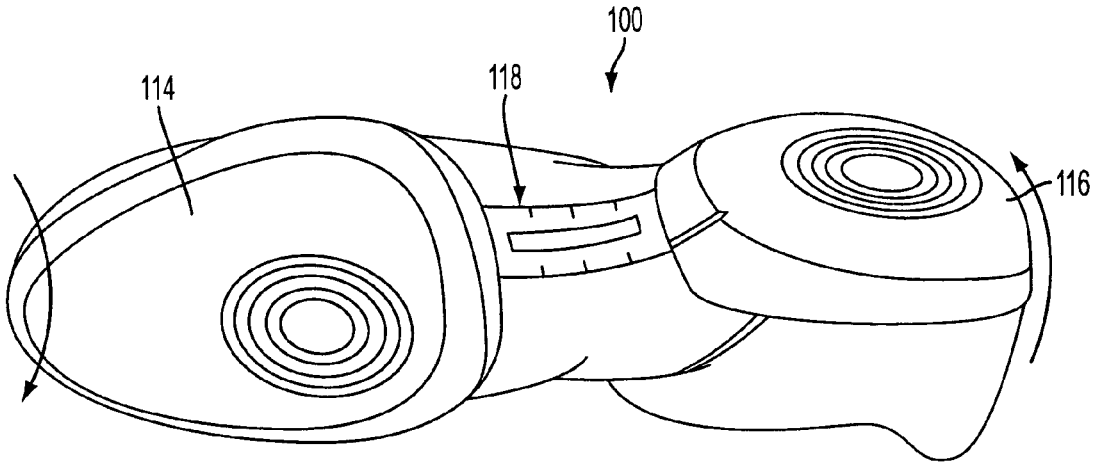
FIG. 7B is a bottom plan view of the article of footwear of FIG. 1 illustrating a second twist configuration.

In addition, as shown in FIGS. 7A and 7B, the arch support may be configured to provide flexibility for twisting movements along its length. As such, the arch support may provide little resistance to the twisting movements of FIGS. 7A and 7B in which the forefoot outsole 114 is rotated along the length of footwear 110 in a direction opposite the heel outsole 116. Such movements may be desirable for various types of dance-related activities or other activities.

Referring now to FIGS. 8-11, arch support 132 is shown in greater detail to illustrate various aspects thereof. As shown, the upper surface 133 of arch support 132 may be contoured as desired to support the arch of the foot or to provide other support to the foot. For instance, it may generally be contoured to match the natural, anatomical shape of the foot, such as to have a cup shape or portion thereof at its rearward end for receiving the heel. In addition, peripheral areas of the upper surface 133 may be generally raised to form an arch support region 147 or to provide a depression for receiving and seating the foot. In further embodiments, upper surface 133 may have a non-contoured configuration. Thus, although referred to as an arch support, in other configurations support 132 may be a shank or other midsole support that generally supports the sole of the foot without providing specific support to the arch.

Figure 8:
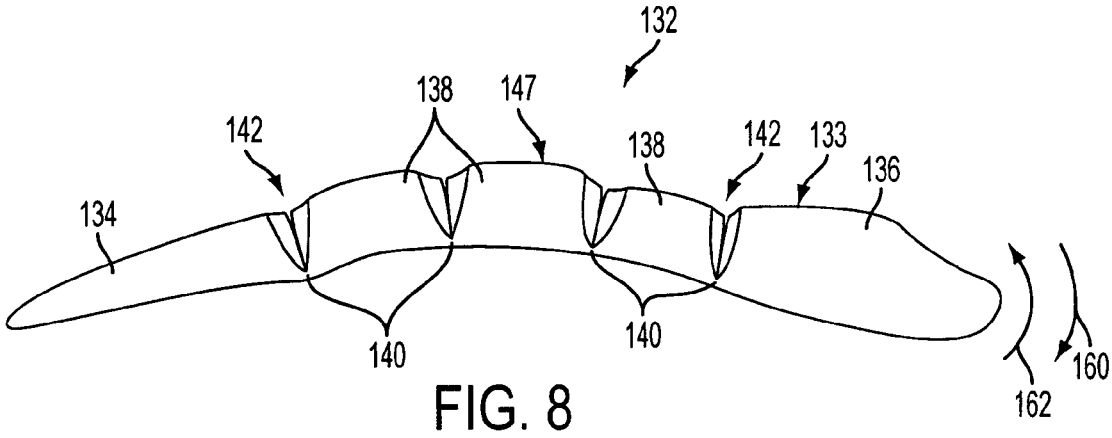
FIG. 8 is a lateral elevational view of the arch support of the article of footwear of FIG. 1 according to an embodiment of the invention.

As shown in FIG. 8, arch support 132 includes a plurality of segments 134, 136 and 138 that can articulate with respect to each other in a first direction 160 away from the foot from a relatively flat configuration, but are restricted from rotating in the opposite, second direction 162 from the generally flat configuration. Thus, arch support 132 generally forms a shank that flexes in first direction 160, but does not flex in the opposite direction 162 or that flexes much less than in direction 160. Arch support 132 includes a forefoot segment 136 at a front end, a rear foot segment 134 at a rear end, and a plurality of middle segments 138 disposed in series therebetween. In preferred configurations, three or four articulatable middle segments 138 are disposed in the arch region 118 of the footwear. However, greater or fewer numbers of middle segments may be used. Three segments provide good structural support to the arch for downwardly applied forces. Three segments also provide good flexibility at the arch region 118 where bending of the foot primarily occurs. In configurations with only two middle segments, the hinge between the segments receives most of the stress related to foot bends and the footwear has a sharp bend in the arch region. When greater numbers of middle segments are used, the support may not have sufficient rigidity for attenuating downwardly applied forces.

Each of the segments are connected to adjacent segments via a hinge structure 140 disposed at a bottom portion of the arch support. Otherwise, a gap 142 is formed between adjacent segments opposite the respective hinge, which increases in size as the arch support is flexed in the first direction 160. The gaps extend completely across an upper surface of the shank between the adjacent segments. The hinge structure may be about 0.5 to 3 mm in thickness and the arch support may have a height of about 3 mm to about 30 mm. Preferably, however, hinges 140 are about 1 mm thick and the arch support has a height of about 5 to 15 mm for many dance-related articles of footwear.

Figure 9:
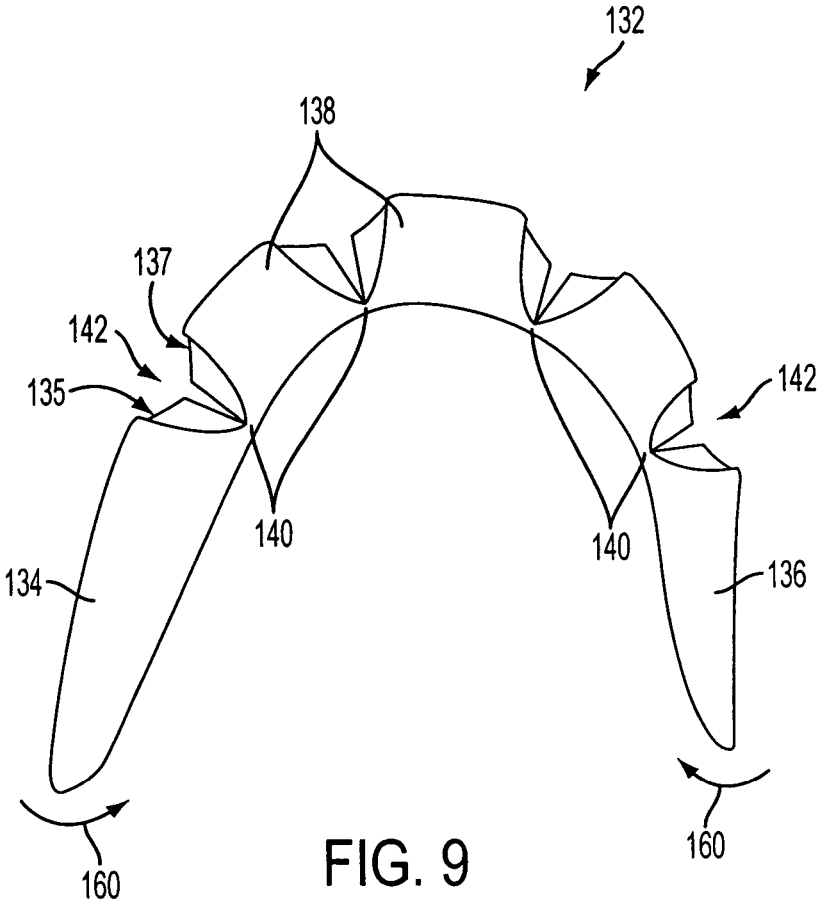
FIG. 9 is a lateral elevational view of the arch support of FIG. 8 shown in a flexed configuration.

As shown in FIG. 9, the segments include opposing shoulder regions 135 and 137 at the gaps between adjacent segments along the upper portion of the segments. The shoulder regions 135 and 137 may exist primarily at the upper portions of the segments, or may extend along the height of the segments above the hinges 140 to provide a relatively large contact area. Each shoulder region may have a shoulder sidewall sloping upwardly in a first direction from a bottom of one of the gaps to a shoulder region top edge and a top surface sloping upwardly in a second direction to a corresponding sidewall of one of the segments at a point below a top of the one of the segments. Nonetheless, when arch support 132 is flexed in the first direction 160, the shoulder regions move apart and the gaps increase. When arch support 132 is flexed in the opposite, second direction 162, the shoulder regions move together to close any gaps until they make contact with and interfere with each other. Interference at shoulder regions 135 and 137 limits articulation of the segments in direction 162 and thereby prevents the arch support from flexing a large amount, if any, in that direction. FIG. 9 illustrates exaggerate flexing of the arch support in direction 162.

Figure 10:
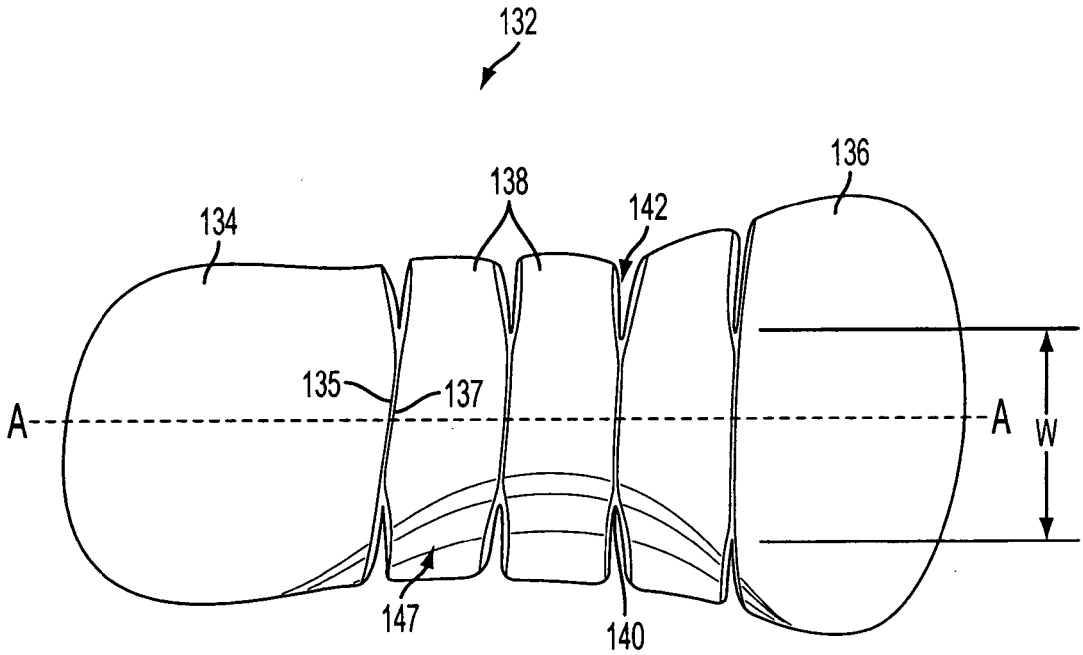
FIG. 10 is a top plan view of the arch support of FIG. 8 shown in an unflexed configuration.
Figure 11:
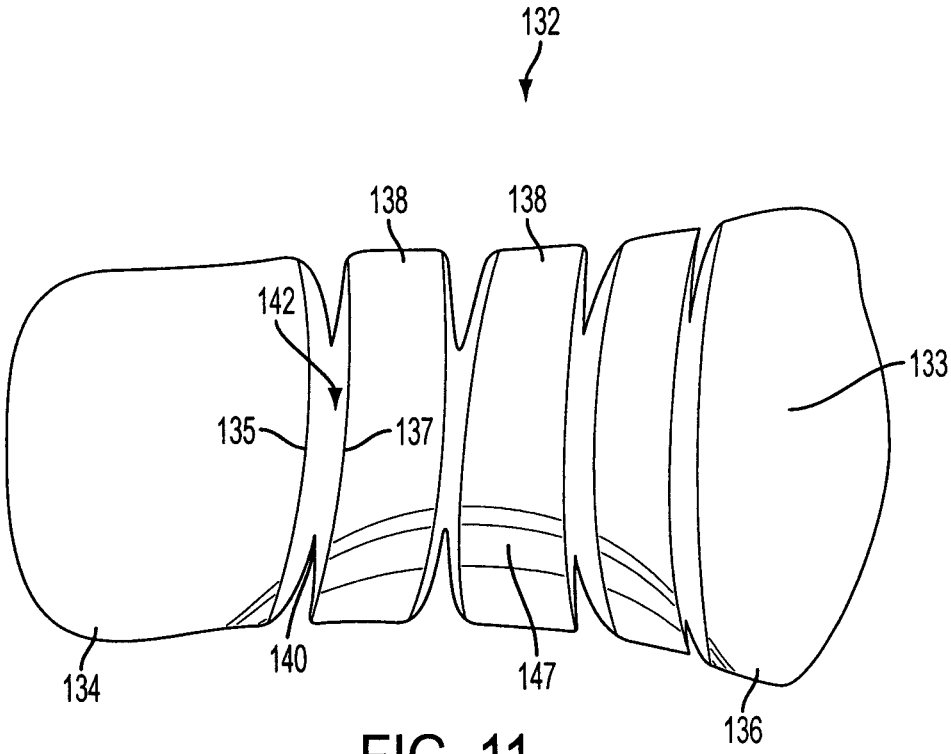
FIG. 11 is a top plan view of the arch support of FIG. 8 shown in a flexed configuration.
Figure 12:
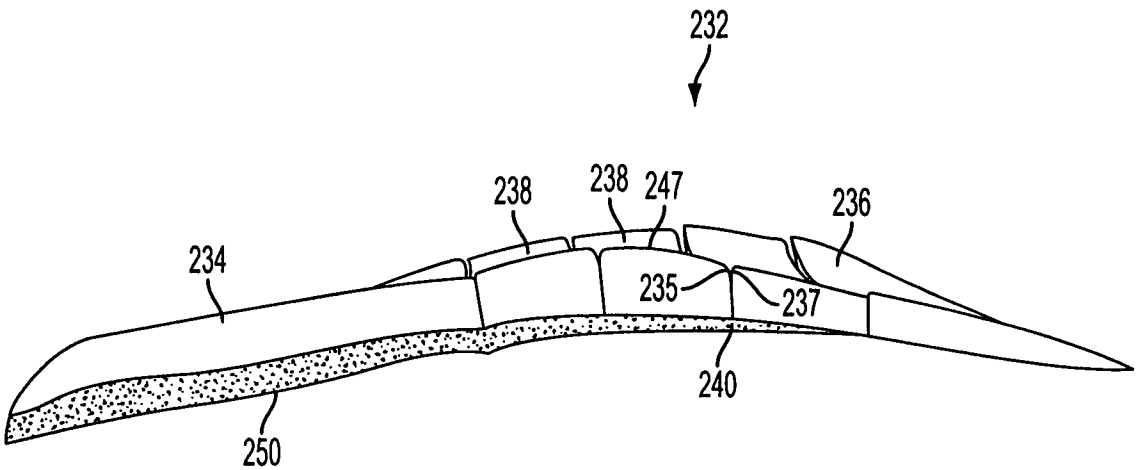
FIG. 12 is a lateral elevational view of an arch support according to an embodiment of the invention.

As shown in FIG. 10, hinge structures 140 extend between adjacent segments in a central portion thereof and have a width W. As such, hinges 140 are generally aligned to form a wide longitudinal axis A along the arch support about which the segments may have limited rotation. Thus, arch support 132 can twist along its length to provide further flexibility to footwear 100. The width W of the hinge structures may be increased or decreased as desired to provide varying degrees of twistability. Shoulders 135 and 137 are preferably configured to make contact with each other in the central region along width W, but may extend more or less to provide a desired amount of counter-moment or stopping torque to movements in direction 162. In addition, the shoulder regions may be configured to have larger or smaller contact areas as desired. In the configuration shown in FIG. 10, shoulders 135 and 137 are scalloped away from each other beyond the width W of the hinge structures. Thus, gap 142 is larger along peripheral portions of the segments and exists to a degree even when the opposing shoulder regions interfere with each other. Keeping the size of the shoulder regions relatively small in comparison with the width of the arch support may be desirable, such as to avoid pinching any material within gaps 140, to reduce any noise associated with contact between shoulder regions, and to allow a degree of flexibility in direction 162.

Arch support 132 may be formed from a thermoplastic elastomer, such as nylon, polyethylene or polypropylene. In a preferred configuration, a polyether block amide (PEBA), such as the PEBA material known as PEBAX that is manufactured by ARKEMA, is used to mold arch support 132 due to its resilience, strength properties and memory characteristics for retaining its molded shape. Thus, structural features of arch support 132, such as hinges 140 and shoulder regions 135 and 137, maintain their shape well over long term use with the PEBAX material. In addition, an arch support made from such a material is relatively stiff, but can bend as necessary to absorb shocks and provide limited reverse flexibility.

A plurality of manufacturing methods are suitable for forming arch support 132. For instance, arch support 132 may be formed as a unitary piece that is injection molded such that the hinges 140 and segments 132, 136 and 138 are formed from the same material via a single injection mold. The arch support may be molded in the flexed configuration shown in FIG. 9 to permit the mold tooling to extend within gaps 142 and thereby form the segments and the hinges. Injection molding gates may be provided at each segment to ensure that thermoplastic material is provided to each segment without material flow being constricted in the hinge regions. Individual molding gates for each segment may also ensure that the thermoplastic material flows well into the hinges to provide robust, dense hinges 140. Once the arch support is removed from the mold, it may be held in a substantially flat configuration as it cools to reduce any mold memory that could excessively bias the arch support toward the downwardly flexed configuration in which it was molded.

Referring now to FIGS. 12-16, a flexible arch support 232 is shown that further illustrates aspects of the invention. Arch support 232 is generally the same as arch support 132, except as discussed hereafter. Arch support 232 includes a rear segment 234, a front segment 236, and middle segments 238 that are connected to each other via a flexible sheet 250. Flexible sheet 250 generally extends the length of the arch support and is attached to an underside 270 thereof, which is opposite its top side 233 oriented toward the foot when placed in footwear.

Figure 13:
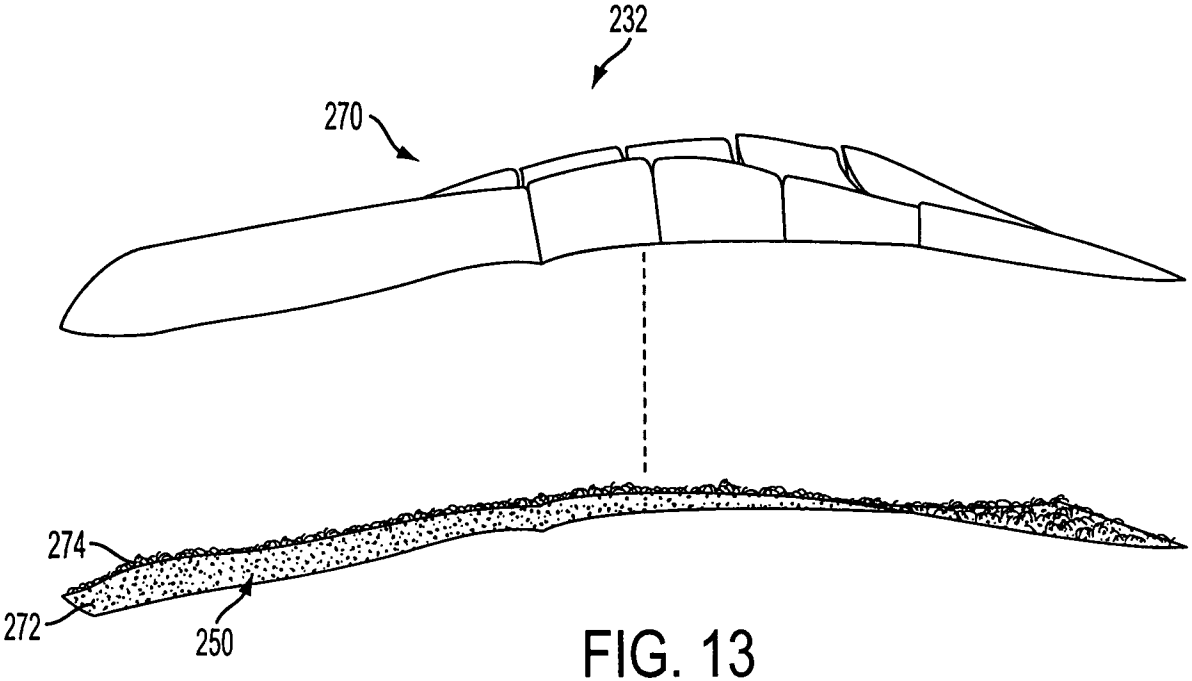
FIG. 13 is an exploded view of the arch support of FIG. 12.

Flexible sheet 250 is a pile fabric that includes a fabric sheet 272 and fibers 274, as shown in FIG. 13. The fabric sheet 272 may include a tightly woven fabric, such as a nylon fabric, that provides a structural framework to maintain the segments in the desired arrangement while permitting them to articulate about bend regions of the fabric. However, fabric sheet 272 may be made from a wide variety of synthetic and non-synthetic fibers, non-fibrous materials such as a sheet of plastic material, or other materials such as a wire mesh. Fibers 274 may be made from a wide variety of synthetic and non-synthetic materials, such as polyethylene, polypropylene, nylon or other plastic and non-plastic materials. In a preferred configuration, flexible sheet 272 and fibers 274 are both made from a nylon material. In one configuration, flexible sheet 250 may be the loop side of a hook and loop fastener, such as the fastener known as VELCRO. Flexible sheet 250 may be attached to the segments via molding the segments into the fibers 274, as discussed further below. In addition, flexible sheet 250 may be attached via other means, such as via an adhesive attachment.

Figure 14:
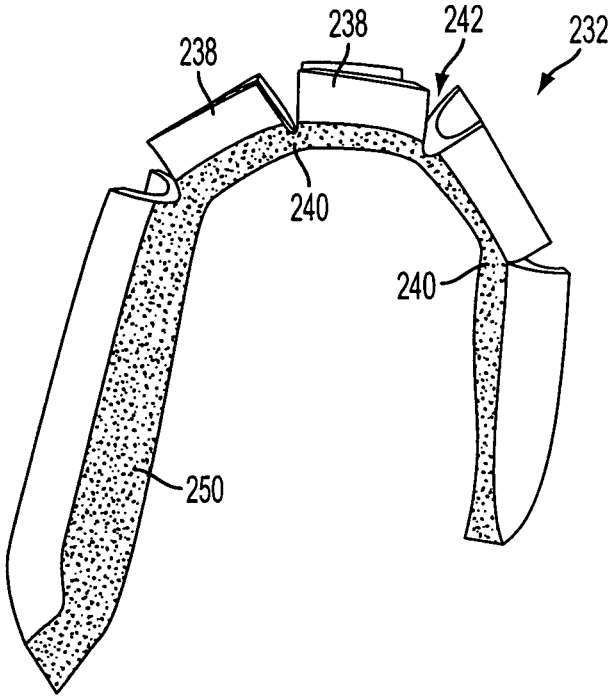
FIG. 14 is a lateral elevational view of the arch support of FIG. 12 shown in a flexed configuration.

As shown in FIG. 14, flexible sheet 250 is bendable at pivot regions between the segments, which form hinges 240 between the segments. As such, the segments are able to articulate with respect to each other about the flexible sheet in a downward direction, which permits arch support 232 to be directionally flexible. However, arch support is limited in its flexibility in the opposite direction via shoulder regions 235 and 237 of adjacent segments that interfere to limit articulation in the upward direction. When the arch support is flexed upward, flexible sheet 250 is placed in tension at hinges 240 and shoulder regions 235 and 237 make contact to interfere with each other. As such, fabric sheet 272 shown in FIG. 13 preferably has good tensile strength properties for resisting tension at the hinges when the arch support is flexed upward, such as is provided by tightly woven fabrics made from nylon or other high strength, resilient materials.

Figure 15:
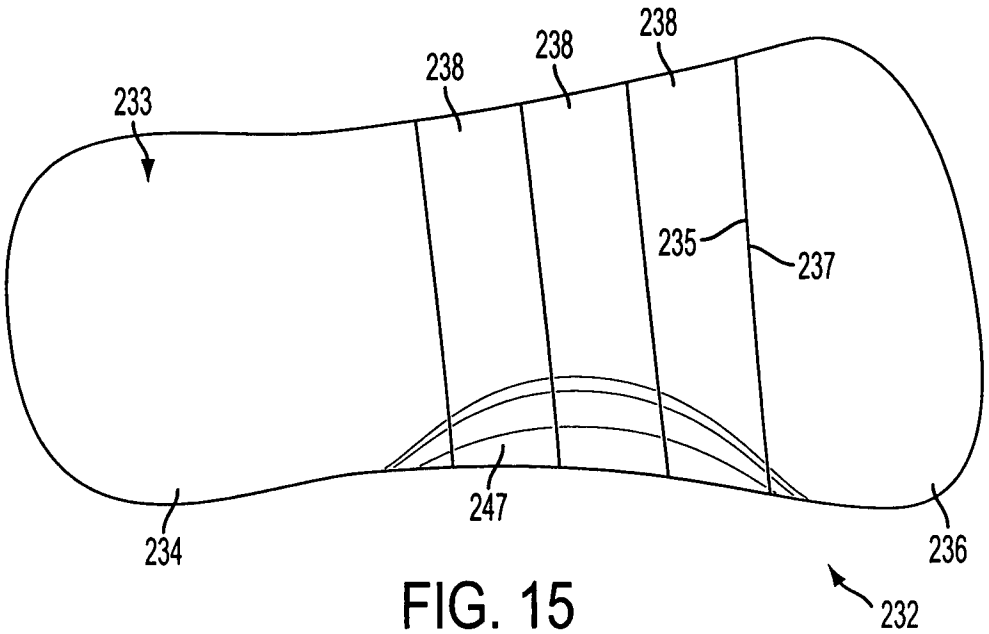
FIG. 15 is a top plan view of the arch support of FIG. 12 shown in an unflexed configuration.

Arch support 232 also differs from arch support 132 in that adjacent segments make contact with each other substantially along their entire width. Thus, as shown in FIG. 15, shoulder regions 235 and 237 abut one another substantially across the width of the arch support. In addition, shoulder regions 235 and 237 generally abut one another in the relaxed state. As such, gap 242 shown in FIG. 14 does not exist or is very small in the relaxed, substantially flattened state of FIG. 15.

The gap 242 can be kept small or may be substantially nonexistent in the relaxed state due to the use of flexible sheet 250 for hinges 240, rather than using a thermoplastic material for the hinges as with configurations of arch support 132. This is because thermoplastic material typically has a mold memory, which biases the material toward returning its as-molded configuration when in the natural state. Arch support 132 will likely be molded in a somewhat downwardly flexed configuration to allow space for the tooling to form shoulder regions 135 and 137, as shown in FIG. 9. Thus, arch support 132 will likely have some mold memory that will bias it toward a downwardly flexed configuration rather than toward the flat configuration of arch support 232. Arch support 232 can be advantageous for use with footwear in which very little upward flexibility is desired in the arch region. The wide shoulder regions 235 and 237 and the use of flexible sheet 250 for hinges 240 permit a flattened configuration to exist in the natural state. The use of relatively rigid thermoplastic material for the segments permits arch support 232 to permit very little upward flexibility while permitting a large degree of downward flexibility.

Figure 16:
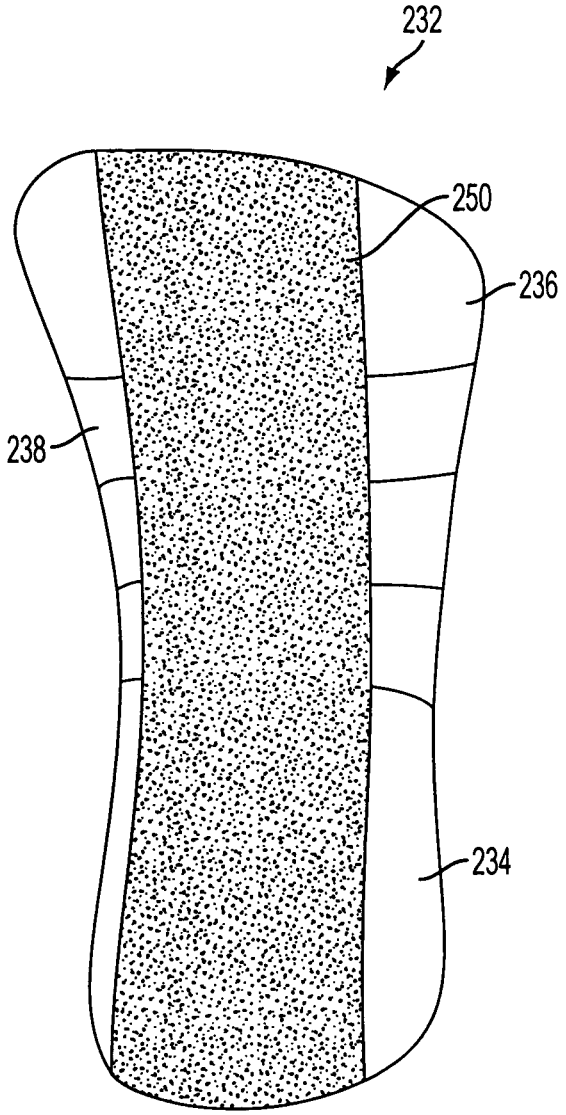
FIG. 16 is a bottom plan view of the arch support of FIG. 15.

Arch support 232 can also provide twisting flexibility along its length, as desired. As shown in FIG. 16, flexible sheet 250 is shown to have a width less than that of the segments 234, 236 and 238. Hinges 240, therefore, do not extend across the width of arch support 232, which can improve twisting flexibility along the length of the arch support. More or less flexibility can be provided by adjusting the width of flexible sheet 250 to extend more or less across the width of the arch support. For example, a flexible sheet having a width that is about 25% of the width of the arch support can provide an arch support with high twisting flexibility along its length. In contrast, a flexible sheet having a width substantially matching the width of the arch support may have very little twisting flexibility.

Figure 17:
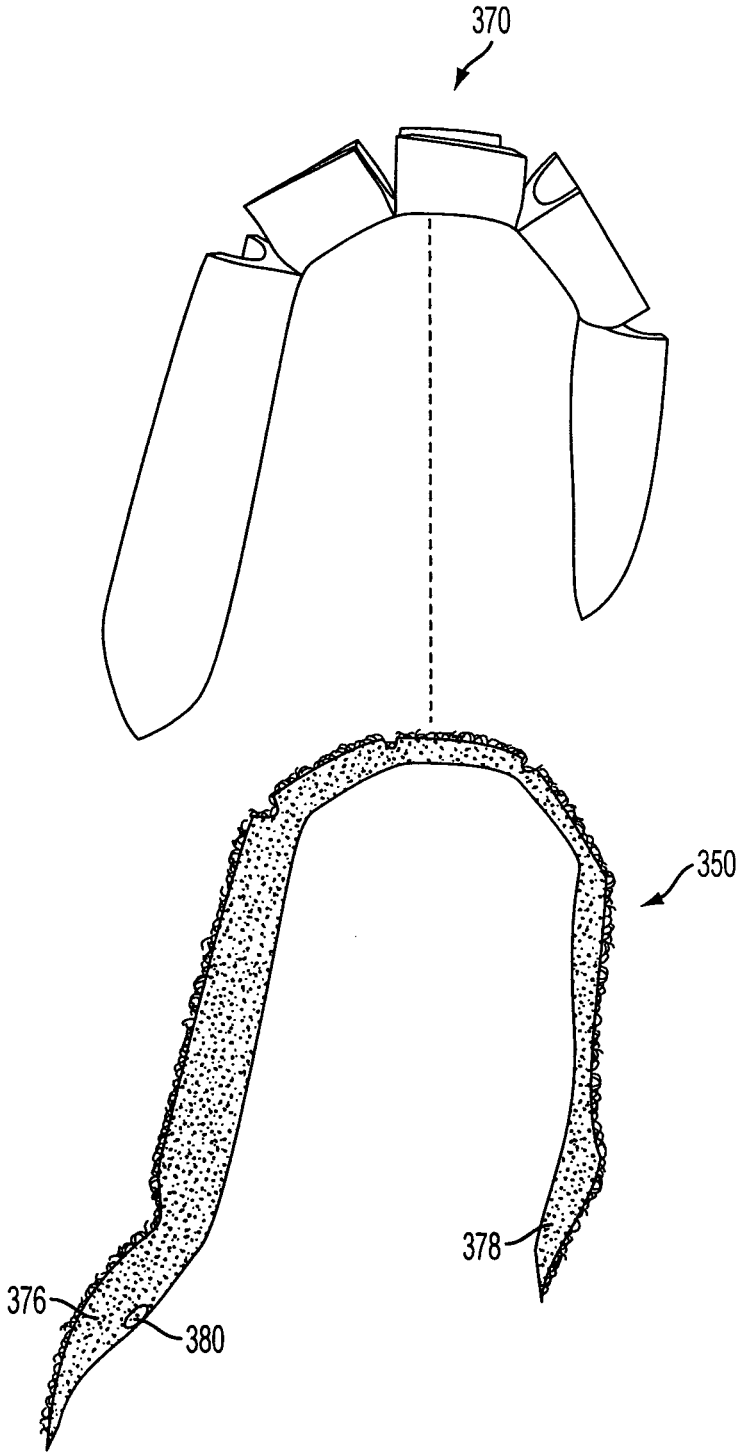
FIG. 17 is an exploded view of the arch support of FIG. 12 illustrating a manufacturing process thereof according to embodiments of the invention.
Figure 18:
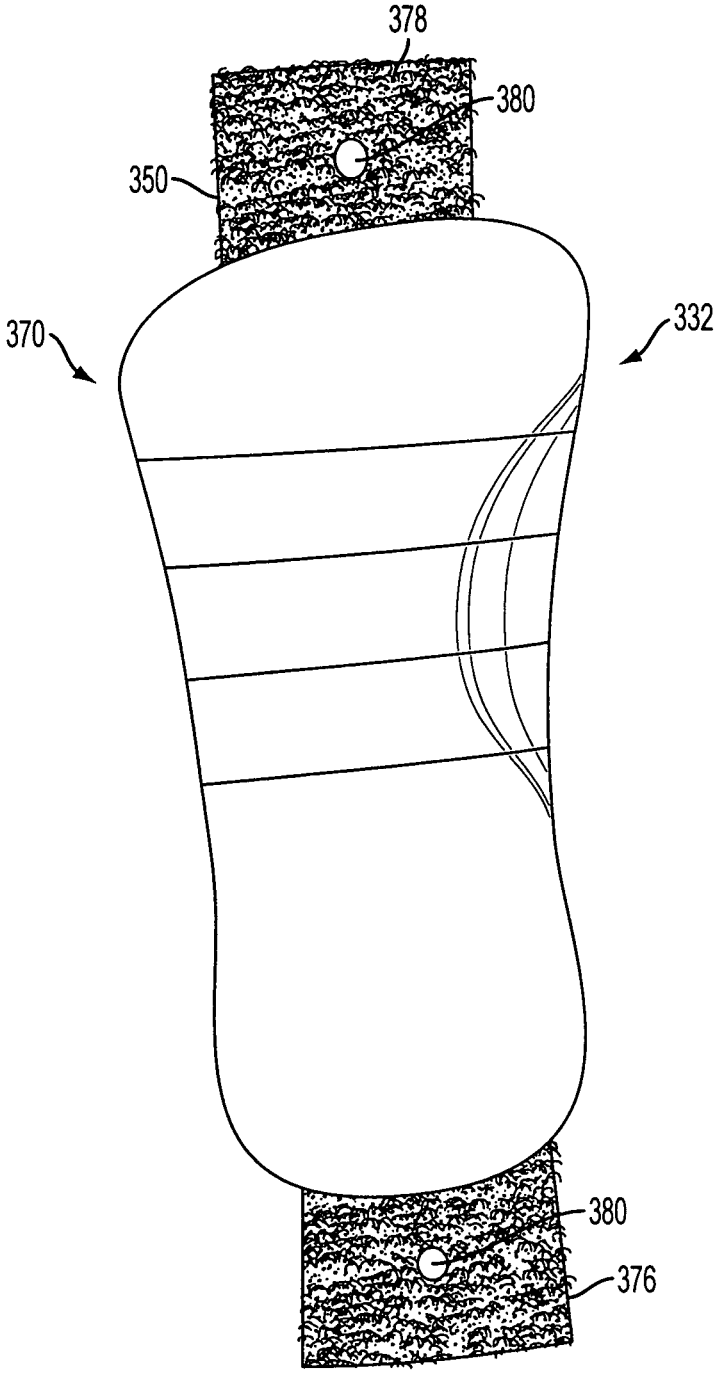
FIG. 18 is a lateral elevational view of the arch support of FIG. 17 shown shortly after a manufacturing step of injection molding.
Figure 19:
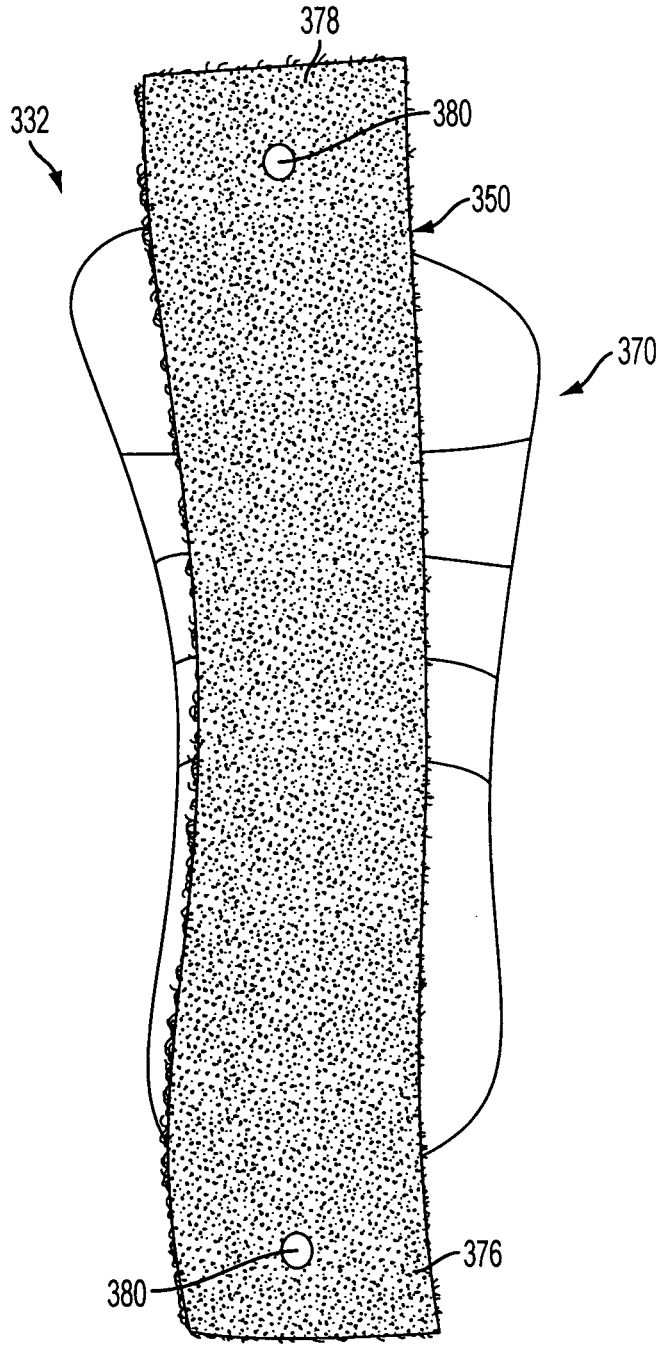
FIG. 19 is a bottom plan view of the arch support of FIG. 18.

As with arch support 132, arch support 232 may be formed via a plurality of manufacturing methods. For instance, as illustrated in FIGS. 17-19, arch support 232 may be formed by injection molding the segments 370 onto the pile side of flexible material 350. Flexible material 350 is the same as flexible material 250 except that it includes tabs 376 and 378 at opposite ends. The tabs are used to anchor the flexible material in the mold (not shown) while thermoplastic material is injected into the mold. Holes 380 formed in the tabs may be provided to assist with placing and anchoring the flexible material in the mold equipment.

During molding, the thermoplastic material infiltrates and intermingles with the fibers 374 on the pile side of the flexible material, which are exposed inside the mold. As such, a strong bond is provided between the flexible material and the segments. The fibers may be made of the same or similar material as the segments, or they may have the same or a similar melting point as the material for the segments. Thus, the fibers may at least partially melt during the molding process to improve the bond between flexible material and the segments. A bonding agent may alternatively be added to the fibers prior to molding the segments. In an alternative manufacturing configuration, the flexible material may be affixed to the segments via an adhesive.

Figure 20:
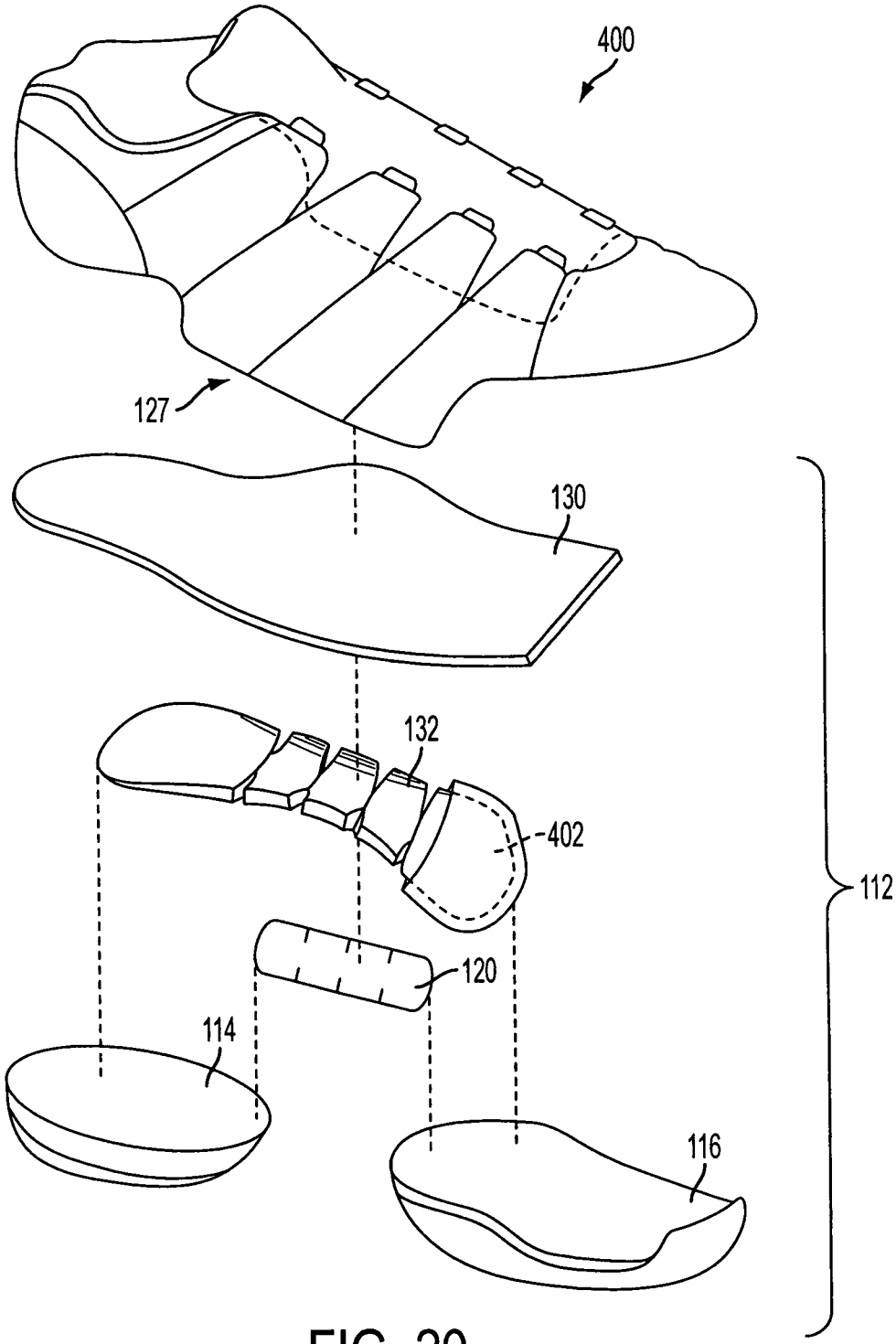
FIG. 20 is an exploded view of an article of footwear according to a further embodiment of the invention.

FIG. 20 illustrates an article of footwear 400 that is generally the same as article of footwear 100, except with respect to the sleeve 490. Sleeve 490 is a partial enclosure disposed about a front portion of arch support 132. Sleeve 490 is attached to front outsole 116 and thereby retains a front portion of the arch support in a desired configuration. Sleeve 490 may be made from a variety of materials, but is preferably made from a stretchable material having a relatively low coefficient of friction. For instance, sleeve 490 may be made from the nylon materials known as LYCRA or SPANDEX.

Arch support 132 is permitted to slide within sleeve 490, which permits front outsole 116 to translate with respect to arch support 132. This may be advantageous for enhancing the flexibility of the footwear during bending and curling movements of the foot. For instance, the arch support may have a radius of curvature during downward bending that is greater than the radius of curvature between rear sole 114 and front sole 116, which can cause shear stresses between the arch support and the sole structures 114 and 116. Permitting one end of the arch support to translate with respect to sole structure 114 or 116 can reduce or avoid these stresses, improve flexibility and avoid damage resulting from the stresses. Other configurations may be provided to improve flexibility for downwardly directed bending and to reduce stresses in the sole structure. For example, a sleeve may be placed over the rear end of the arch support, may cover all but one end of the arch support, or may enclose the entire arch support.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. A directionally flexible shank for a sole of an article of footwear, the directionally flexible shank comprising:

a plurality of segments arranged seriatim along a length of the directionally flexible shank, sidewalls of adjacent ones of the segments spaced from one another to form gaps extending completely across an upper surface of the shank between the adjacent ones of the segments, the upper surface configured to face an arch of a user's foot;

a pair of shoulder regions positioned within each one of the gaps, each shoulder region having a shoulder sidewall sloping upwardly in a first direction from a bottom of the one of the gaps to a shoulder region top edge and a top surface sloping upwardly in a second direction to a corresponding sidewall of one of the segments at a point below a top of the one of the segments; and a plurality of hinge structures, each one of the hinge structures being disposed between adjacent ones of the segments and oriented in a direction transverse to the length of the directionally flexible shank, the segments and hinge structures being formed from a unitary material, a width of each hinge structure being less than a width of the adjacent segments.

2. The directionally flexible shank recited in claim 1, wherein each segment includes a bottom portion and an opposite upper portion, and the hinge structures are disposed on the bottom portion.

3. The directionally flexible shank recited in claim 2, wherein opposing ones of the shoulder regions move apart when the directionally flexible shank flexes in a first direction about the hinge structures and move together when the directionally flexible shank flexes in an opposite second direction.

4. The directionally flexible shank recited in claim 3, wherein opposing ones of the shoulder regions form stops that interfere with each other when the directionally flexible shank flexes in the second direction to resist bending of the directionally flexible shank in the second direction.

5. The directionally flexible shank recited in claim 1, wherein the hinge structures are disposed in a central, longitudinal portion of the directionally flexible shank to generally form a longitudinal axis of the directionally flexible shank and to permit twisting of the directionally flexible shank about the longitudinal axis.

6. The directionally flexible shank recited in claim 1, wherein the directionally flexible shank is formed from an elastomeric material and the hinges comprise living hinges of the elastomeric material.

7. The directionally flexible shank recited in claim 6, wherein the elastomeric material includes a polyether block amide (PEBA).

8. The directionally flexible shank recited in claim 1, wherein upper surfaces of the segments include contours adapted for engaging a foot.

9. The directionally flexible shank recited in claim 8, wherein the contours include a raised portion forming an arch support.

10. The directionally flexible shank recited in claim 8, wherein the contours include a dished portion for receiving a user's heel.

11. An arch support for an article of footwear, the arch support comprising:

a plurality of segments arranged seriatim along a length of the arch support and forming a top surface, the top surface having a raised contour forming a support for the arch of a foot, sidewalls of adjacent ones of the segments spaced from one another to form gaps on the top surface between the adjacent ones of the segments, the plurality of segments being formed of a thermoplastic, material;

a pair of shoulder regions positioned within each one of the gaps, each shoulder region having a shoulder sidewall sloping upwardly in a first direction from a bottom of the one of the gaps to a shoulder region top edge and a top surface sloping upwardly in a second direction to a corresponding sidewall of one of the segments at a point below a top surface of the one of the segments; and a plurality of hinge structures, each one of the hinge structures being disposed between adjacent ones of the segments and oriented in a direction transverse to the length of the arch support, the hinge structures permitting the plurality of segments to rotate about respective ones of the hinges in a first direction away from the top surface, while limiting rotation of the plurality of segments in an opposite, second direction, the segments and hinge structures being formed from a unitary material, a width of each hinge structure being less than a width of the adjacent segments.

12. The arch support recited in claim 11, wherein, opposing ones of the shoulder regions move apart when the arch support flexes in the first direction about the hinge structures and move together when the arch support flexes in the opposite second direction.

13. The arch support recited in claim 11, wherein each segment includes a bottom portion and an opposite upper portion, and the hinge structures are disposed on the bottom portion.

* * * * *